US008156616B2

(12) United States Patent
Lo

(10) Patent No.: US 8,156,616 B2
(45) Date of Patent: Apr. 17, 2012

(54) SAFE PACIFIER CLIP

(75) Inventor: Chin-Tien Lo, Taoyuan Hsien (TW)

(73) Assignee: Tien Chung Ent. Co., Ltd., Taoyuan Hsien (TW)

( * ) Notice: Subject to any disclaimer, the term of this patent is extended or adjusted under 35 U.S.C. 154(b) by 463 days.

(21) Appl. No.: 12/505,929

(22) Filed: Jul. 20, 2009

(65) Prior Publication Data

US 2010/0313390 A1 Dec. 16, 2010

(30) Foreign Application Priority Data

Jun. 15, 2009 (TW) ..... 98210642 U

(51) Int. Cl.
*A61J 17/00* (2006.01)
*A45F 5/02* (2006.01)
*A44B 99/00* (2010.01)

(52) U.S. Cl. ..... 24/516; 24/504; 24/3.11; 24/3.12; 24/3.13

(58) Field of Classification Search ..... 24/3.11, 24/3.12, 3.13, 504, 516
See application file for complete search history.

(56) References Cited

U.S. PATENT DOCUMENTS

| | | | | |
|---|---|---|---|---|
| 4,005,510 | A * | 2/1977 | Noda | 24/504 |
| 4,086,686 | A * | 5/1978 | Takabayashi | 24/504 |
| 4,141,119 | A * | 2/1979 | Nodo | 24/504 |
| 5,400,483 | A * | 3/1995 | Noda | 24/504 |
| 5,778,497 | A * | 7/1998 | Noda | 24/504 |
| 6,260,244 | B1 * | 7/2001 | Noda | 24/504 |
| 6,263,702 | B1 * | 7/2001 | Lo | 24/516 |
| 6,327,757 | B1 * | 12/2001 | Noda | 24/504 |
| 6,516,500 | B2 * | 2/2003 | Ogino et al. | 24/504 |
| 7,003,854 | B2 * | 2/2006 | Takabayashi et al. | 24/504 |
| 2004/0205943 | A1 * | 10/2004 | Takabayashi et al. | 24/504 |
| 2010/0031481 | A1 * | 2/2010 | Lo | 24/499 |

* cited by examiner

*Primary Examiner* — Robert J Sandy
(74) *Attorney, Agent, or Firm* — Guice Patents PLLC

(57) ABSTRACT

A safe pacifier clip including a base sheet, a pulling member, a latching member, a clamping member and a tying tool. A connecting sheet is longitudinally connected between two protruding sheet columns and the height of the connecting sheet is lower than that of the sheet columns, a first flange is installed on the top end of the connecting sheet; a second flange provided on the top end of the latching member is installed in the connecting sheet and is provided adjacent to the inner surface of the first flange; an opening at the bottom end of the cap-shaped clamping member is provided to the first and the second flanges that are in a stacking status, and arc-shaped clamping sheets provided at the front and the rear ends of the clamping member clamp the two flanges.

13 Claims, 8 Drawing Sheets

SAFE PACIFIER CLIP

BACKGROUND OF THE INVENTION

1. Field of the Invention

The present invention relates to a pacifier clip, more particularly to a safe pacifier clip that is strong in structure, easy in use and complies with safety regulations issued by many countries.

2. Description of Related Art

The motion of an infant sucking a pacifier is to give the infant the sense of comfort and security; especially when an infant wants to sleep but keeps crying and grumping, a pacifier is often served as a comforting means to put the infant into sleep; it is not rare that a pacifier is often out of sight while an infant was playing, so when the pacifier is needed and can not be found in time, it may result in that the infant will cry or even have a temper therefore the infant is more difficult to be taken care of; various types of pacifier clips are invented by skilled people in the art for clipping a pacifier on the cloth worn by the infant, so the pacifier is prevented from being losing and this often provides a good outcome.

In view of the described disadvantages, the applicant of the present invention has disclosed the Taiwan Patent No. 353304, titled Structure improvement of accessory, for overcoming disadvantages caused by a conventional pacifier clip; the accessory is mainly composed by a main sheet 10, a pulling sheet 20 and a latching sheet 30; the operating fashion of the accessory is that by connecting the pulling sheet 20 and the latching sheet 30 within a sheet range 101 defined on the back of the main sheet 10, a sheet tenon 201 of the pulling sheet 20 is connected to a hook section 102 and an angled tenon 103 provided on the sheet range 101, and a sheet hook 301 of the latching sheet 30 is connected to an axial tenon 104 of the sheet range 101; when a sheet button 202 of the pulling sheet 20 is outwardly pulled, the inner side of the sheet tenon 201 is in contact with the angled tenon 103, so a straight section 302 of the latching sheet 30 is extruded by the front portion of the sheet tenon 201, and the latching sheet 30 is operated around the axial tenon 104 served as an axial core to let a clip sheet 303 outwardly raise, therefore a gap is formed between the clip sheet 303 and sheet teeth 105 in the bottom of the sheet range 101; if the pulling sheet 20 is downwardly pressed, the straight section 302 is fallen due to lack of support provided by the front portion of the sheet tenon 201, so the clip teeth 304 on the inside of the clip sheet 303 and the sheet teeth 105 are in an engaging status. Furthermore, a decoration sheet 40 is connected to the front of the main sheet 10 and a ring 501 in the bottom of a chain 50 is fastened between the main sheet 10 and the decoration sheet 40; the other end of the chain 50 is connected to a conventional opening/closing buckling ring so the pacifier is connected to the buckling hooks.

The above mentioned art has overcome many disadvantages of conventional pacifier clips. Because the disclosed accessory is used on an infant, strict safety regulations are made by various countries, take the EU standard EN 12586 for example, any item used on an infant has to be subject to an impact test to ensure no units of the item is broken in pieces that may be swallowed by an infant. The hook section 102 is suspended in the air and connected on sheet range 101 to offer the resilience for pulling outwardly or inwardly by the pulling sheet 20 so the hook section 102 provided at the disclosed accessory is easily to be broken due to reciprocally impact, therefore not complies with the EU safety regulation; and the size of the pulling sheet is relatively too small so people with larger fingers can not easily operate the disclosed accessory.

SUMMARY OF THE INVENTION

One object of the present invention is to provide a safe pacifier clip having an advantage of impact resistance, so the components of thereof are prevented from being broken.

Another object of the present invention is to provide a safe pacifier clip having larger components, especially larger pulling members, for providing a more convenient operation.

For achieving the above mentioned objects, one solution provided by the present invention is to provide a safe pacifier clip, comprises:

a base sheet, a connecting sheet is longitudinally connected between two protruding sheet columns and the height of the connecting sheet is lower than that of the sheet columns, a sheet slot is defined between the connecting sheet and the base sheet, a first flange is installed on the top end of the connecting sheet, at least one row of sheet teeth is adjacently installed at the lower portion of the connecting sheet;

a rack-shaped pulling member, distance between two wing sheets respectively installed at two lateral ends of the pulling member is corresponding to the sheet columns, and the pulling member is installed to the connecting sheet through the top end of the sheet slot, a sheet tenon is transversally installed at the bottom ends of the pair of wing sheets, a pressing sheet is installed at the bottom end of the sheet tenon, and a sheet button having a height at least equal to the heights of the sheet columns is installed on the top ends of the two wing sheets;

a latching member having a multi-folded shape, a second flange installed on the top end thereof is installed to the connecting sheet through the bottom end of the sheet tenon and is provided adjacent to the inner surface of the first flange, the second flange is bended then is connected to an engaging sheet having an arc-shaped block, the engaging sheet is bended then is connected to a clamping sheet, at least one row of clamping teeth is installed at the rear end of the clamping sheet;

a cap-shaped clamping member, an opening at the bottom end thereof is provided to the first and the second flanges that are in a stacking status, and arc-shaped clamping sheets provided at the front and the rear ends of the clamping member clamp the two flanges, and an elongated tying tool, one end thereof is installed with a fastening unit fastened on the base sheet, the other end thereof is installed with a connecting unit;

when the pulling member is pulled, the pressing sheet of the sheet tenon is optionally moved and positioned at a top or a bottom oblique surfaces of the block, and the two arc-shaped clamping sheets connected to the two flanges release or store energy, so the clamping sheet at the other end of the latching member is outwardly raised or inwardly clamped, and a gap or an engaging status is formed between the clamping teeth and the sheet teeth.

DETAILED DESCRIPTION OF THE PREFERRED EMBODIMENT

Figure 1:
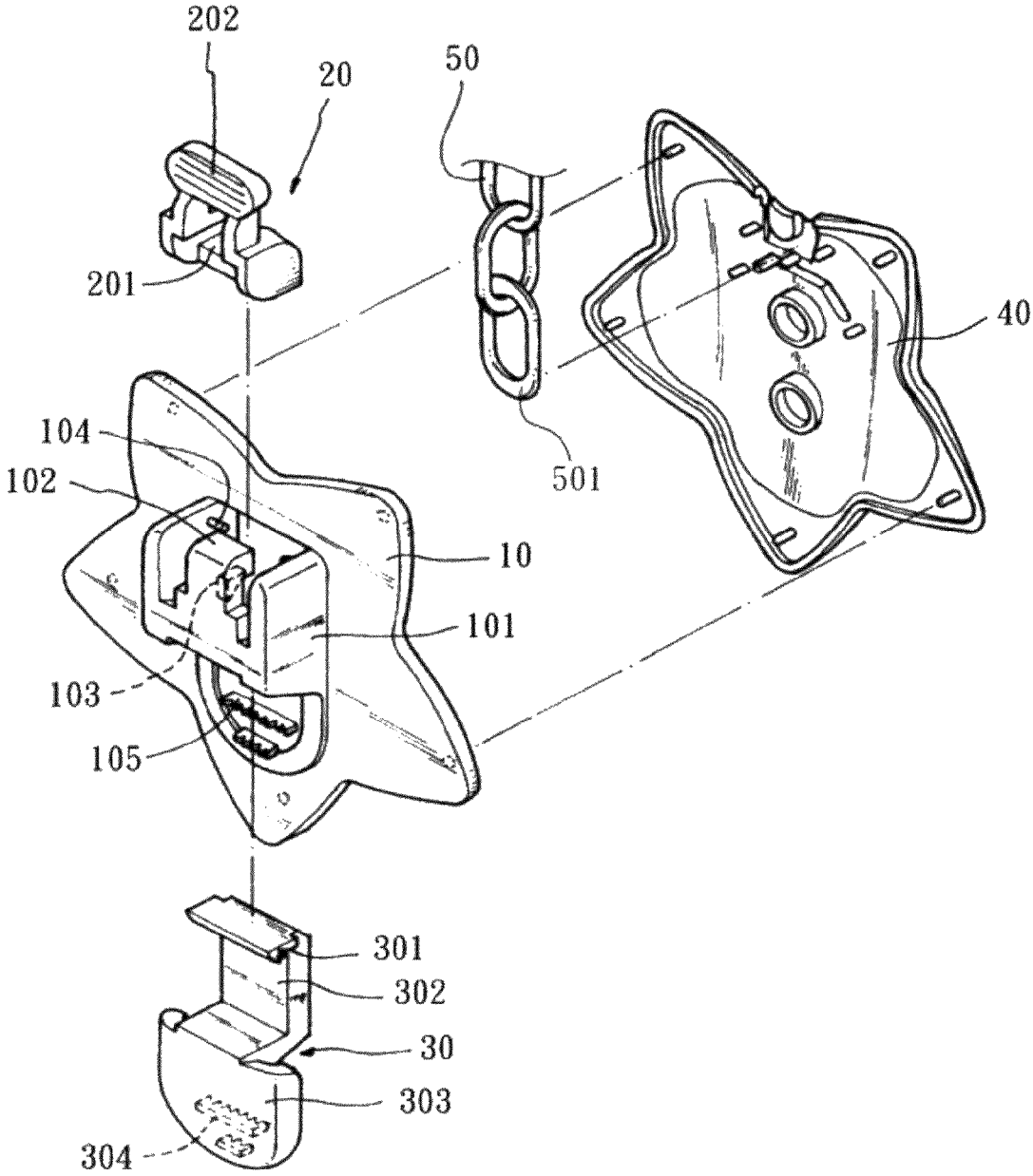
(PRIOR ART) FIG. 1
FIG. 1 is a 3D exploded view of a conventional pacifier clip.
Figure 2:
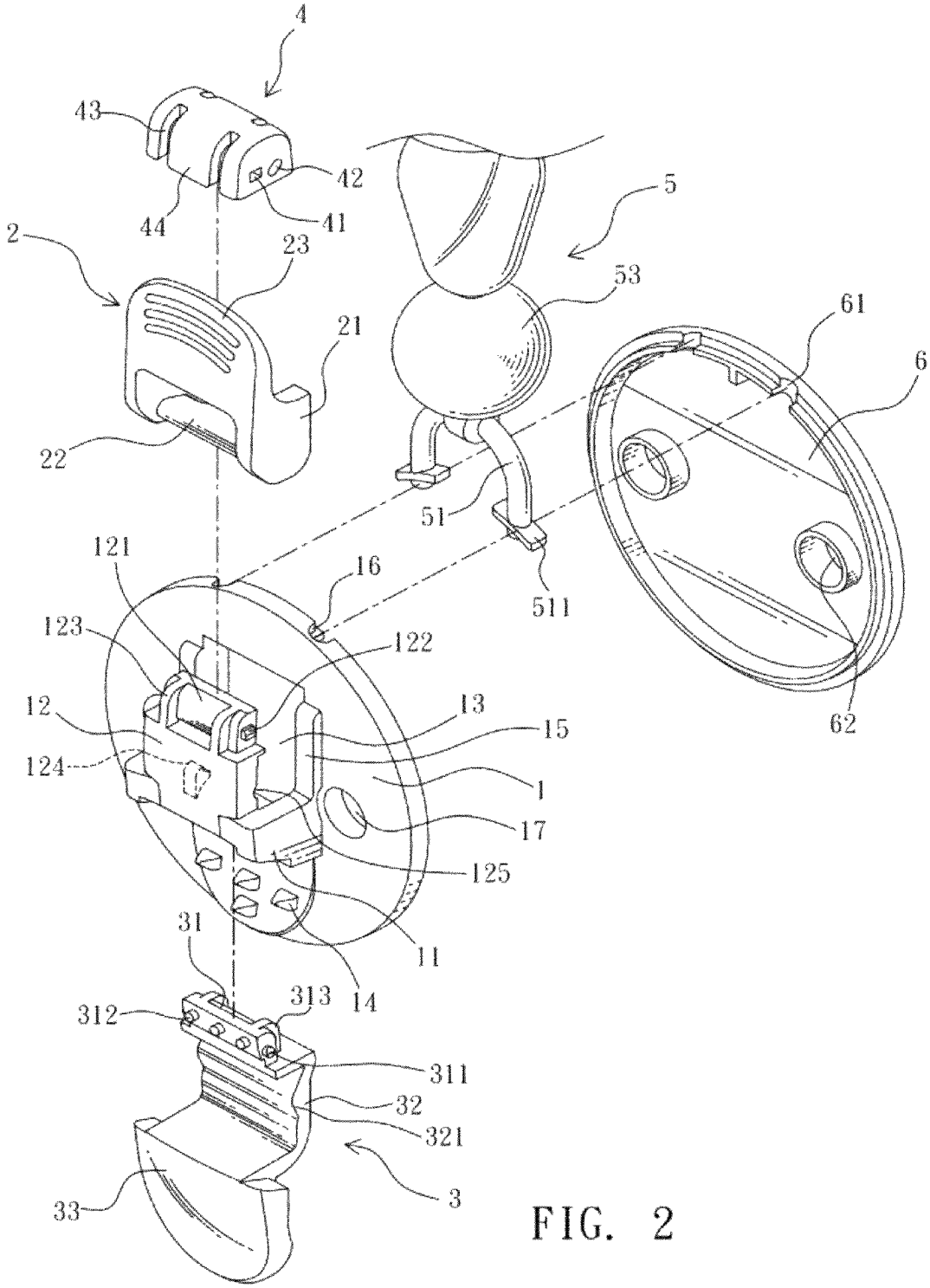
FIG. 2 is a 3D exploded view of the safe pacifier clip of the present invention.
Figure 4:
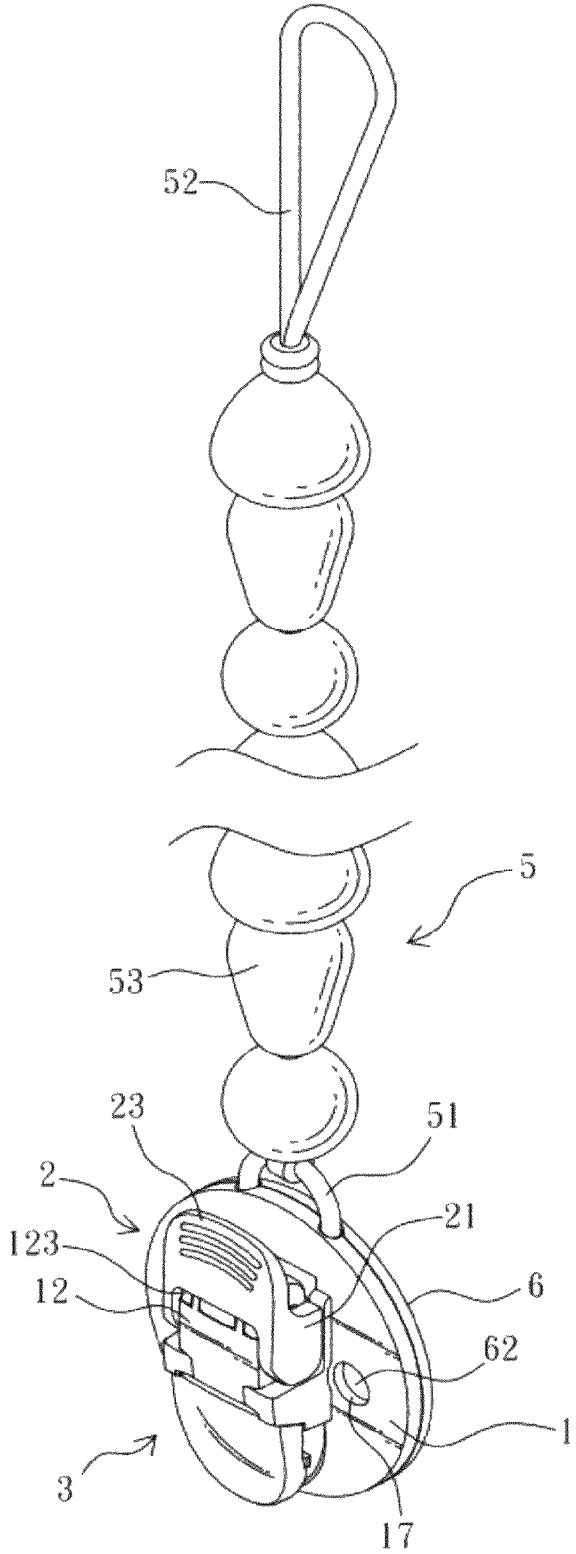
FIG. 4 is 3D view of the assembly of the safe pacifier clip of the present invention.

As shown in FIG. 2 and FIG. 4, the safe pacifier clip provided by the present invention consists of a base sheet 1, a pulling member 2, a latching member 3, a clamping member 4 and a tying tool 5.

The base sheet 1 is an integratedly formed sheet member, which can be made in various geometrical shapes or in a doll-like shape for a better viewing sensation. Two sheet columns 11 are protrudingly and oppositely installed on the front end of the base sheet 1, a connecting sheet 12 is integratedly formed between the two sheet columns 11 and the height of the connecting sheet 12 is lower than that of the two sheet columns 11; a sheet slot 13 is defined between the connecting sheet 12 and the base sheet 1 for being installed with the pulling member 2 and the latching member 3. A free end defined on the top end of the connecting sheet 12 includes a first flange 121, two lateral ends thereof are provided with a pair of buckling hooks 122, the first flange 121 is served to be installed with the clamping member 4, so a buckling status is obtained between the pair of buckling hooks 122 and the clamping member 4 so as to form a latching status capable of avoiding releasing. A pair of convex ribs 123 are longitudinally provided at the front end of the first flange 121 for being installed with a pair of rib slots 43 preset on the front end of the clamping member 4, thus an arc-shaped clamping sheet 44 defined between the pair of rib slots 43 can position and elastically clamp the first flange 121 of the connecting sheet 12.

A wedge-shaped angled tenon 124 is installed at a substantial center location of the inner wall of the connecting sheet 12, a tenon slot 125 crossing through the connecting sheet 12 is installed below the angled tenon 124. The angled tenon 124 is served to prevent the pulling member 2 from longitudinally releasing from the sheet slot 13 and served as an angle limitation for an outward motion of the pulling member 2; the tenon slot 125 is served to accommodate a sheet tenon 22 of the pulling member 2 in a clamping status.

For providing a better clamping effect between clothes and the base sheet 1 and the latching member 3, at least one row of sheet teeth 14 is protrudingly installed at the lower portion of the connecting sheet 12, so a better clamping effect is achieved when the latching member 3 and the base sheet 1 are combined.

The pulling member 2 is a rack-shaped member, and a pair of wing sheets 21 are installed at two lateral ends thereof, the bottom ends of the pair of wing sheets 21 are preferably in an arc shape and the width thereof is corresponding to the pair of sheet columns 11. The bottom ends of the pair of wing sheets 21 is connected through the sheet tenon 22, and the front end of the sheet tenon 22 is received in the tenon slot 125, the rear end thereof is protrudingly installed with at least one pressing sheet 221 for pressing or releasing the latching member 3. A sheet button 23 integratedly formed with the two wing sheets 21 and having a height at least equal to the height of the sheet columns 11 is installed on the top end of the two wing sheets 21. When the pulling member 2 is combined with the base sheet 1, the pulling member 2 is firstly tilted to an angle, so the sheet tenon 22 is able to enter the sheet slot 13 and pass through the angled tenon 124, and the front end of the sheet tenon 22 is received in the tenon slot 125, so the pulling member 2 is installed between the connecting sheet 12 and the sheet slot 13, and the sheet tenon 22 is restrained by the angled tenon 124 and is prevented from releasing from the connecting sheet 12. When the sheet tenon 22 is rotated and is in contact with an oblique surface of the angled tenon 124, a maximum angle limitation is defined for an outward pulling motion.

The characteristic of the pulling member 2 is that when the pair of the wing sheets 21 are clamped, the bottom ends thereof are provide against a sheet step 15 longitudinally extended at the bottom end of the pair of sheet columns 11, so the height of the pair of wing sheets 21 is the same as that of the top ends of the sheet columns 11, in other words the heights of the pair of wing sheets 21 and the sheet button 23 are higher than that of the connecting sheet 12; when subject to an impact test, a hammer is directly hit on the pair of sheet columns 11 and/or the pulling member 2, instead of the connecting sheet 12; so the connecting sheet 12 connecting the two sheet columns 11 is prevented from being directly hit for avoiding breaking.

The latching member 3 is an integratedly formed sheet member having a multi-folded shape, e.g. a Z shape. Two lateral walls of a second flange 31 installed on the top end of the latching member 3 are protrudingly provided with a pair of tenon shafts 311, the front end of the second flange 31 is installed with least one convex positioning bump 312, the rear end thereof is installed with a pair of convex ribs 313 with the same means of the convex ribs 123 being installed on the first flange 121. When the latching member 3 enters from the bottom end of the sheet slot 13, the second flange 31 is provided adjacent to the rear surface of the first flange 121, and the at least one convex positioning bump 312 is received in a concave positioning hole 126 preset at the rear surface of the first flange 121, therefore the pair of convex ribs 123 and the pair of convex ribs 313 are arranged in a front/rear means also the pair of buckling hooks 122 and the pair of tenon shafts 311 are arranged in a front/rear means.

Figure 5A:
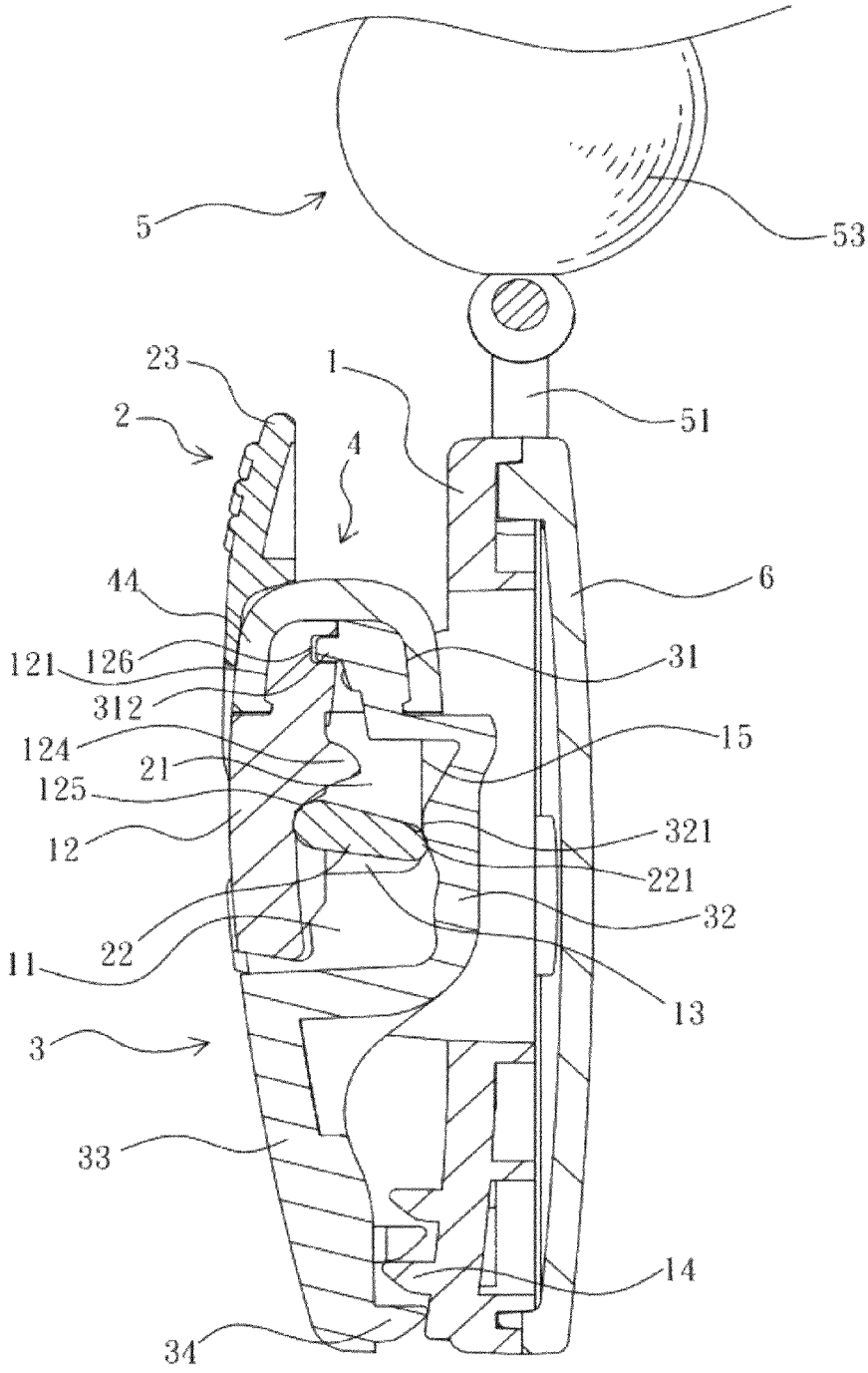
FIG. 5*a* is a cross sectional view illustrating the safe pacifier clip in a clamping status after being assembled.
Figure 5B:
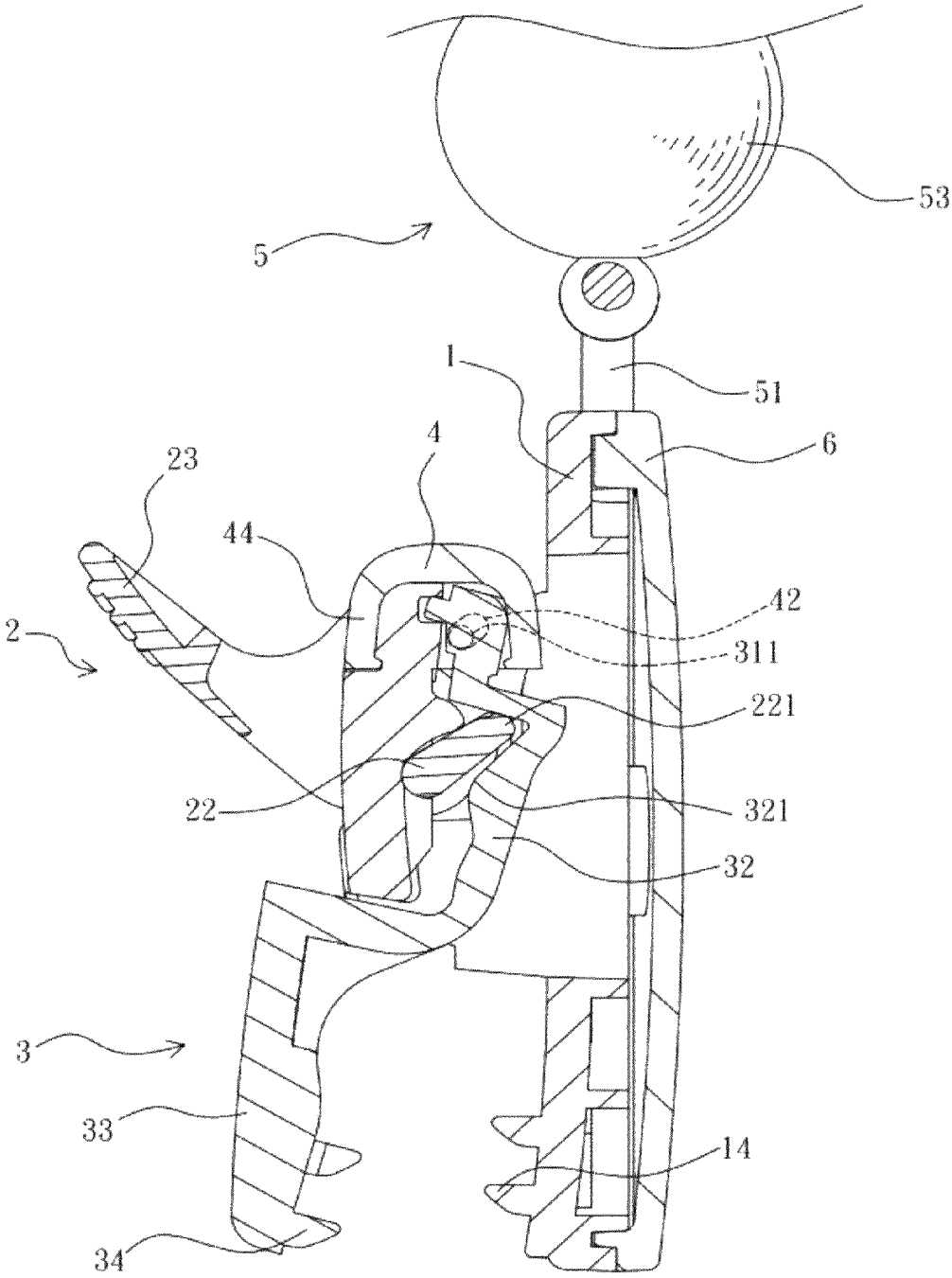
FIG. 5*b* is a cross sectional view illustrating the safe pacifier clip in a releasing status after being operated.

The bottom end of the second flange 31 is bended then is longitudinally extended with an engaging sheet 32 whose front end is protrudingly installed with an arc-shaped block 321, when the latching member 3 is in a clamping status, a bottom oblique surface of the block 321 is pressed by the pressing sheet 221 installed at the bottom end of the sheet tenon 22, as shown in FIG. 5*a*. When the latching member 3 is in a releasing status, the pressing sheet 221 installed at the bottom end of the sheet tenon 22 is rotated to a top oblique surface of the block 321 so as to release the pressing, as shown in FIG. 5*b*. The bottom end of the engaging sheet 32 is connected to a reverse-L shaped clamping sheet 33, the inner surface of the clamping sheet 33 is installed with at least one row of clamping teeth 34 with respect to the location where the sheet teeth 14 is installed; in the clamping status, the sheet teeth 14 and the clamping teeth 34 are intercrossedly engaged to each other for more firmly and stably clamping on clothes.

Figure 3:
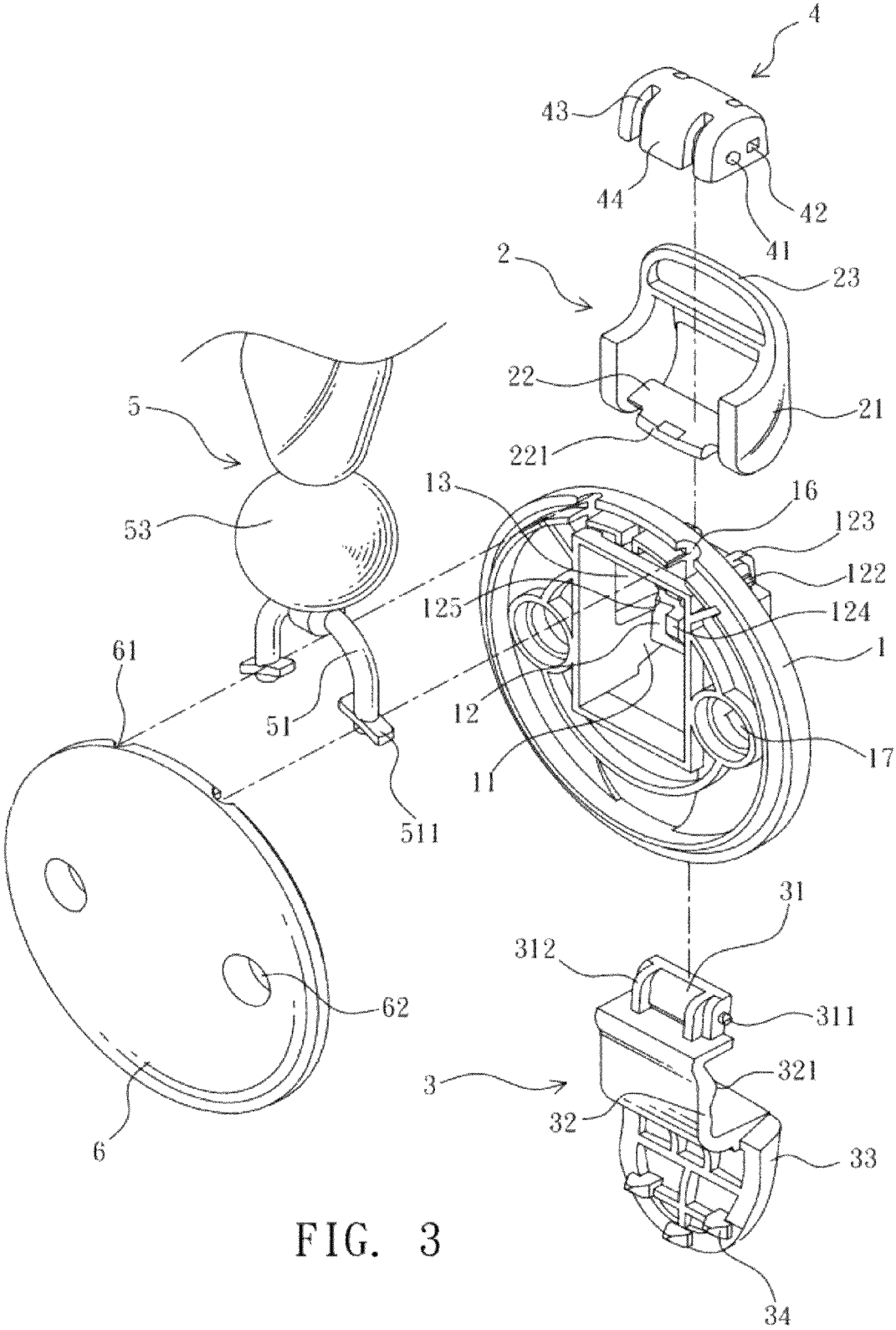
FIG. 3 is a 3D exploded view of the safe pacifier clip of the present invention being viewed from another angle.

The clamping member 4 is a cap-shaped resilient clamping member, two lateral walls thereof are respectively provided with a pair of lock holes 41 and a pair of shaft holes 42 with respect to the pair of buckling hooks 122 and the pair of tenon shafts 311, and the front and rear ends thereof are respectively provided with a pair of rib slots 43 with respect to the locations where the pairs of convex ribs 123, 313 of the first and second flanges 121, 31 are provided, so an arc-shaped clamping sheet 44 is respectively defined between each pair of the rib slots 43. As shown in FIG. 2, FIG. 3 and FIG. 5*a*, a clamping buckle 441 is respectively installed on an inner end of the pair of arc-shaped clamping sheets 44 for being buckled with buckling slots 127, 314 preset of the surfaces of the first and the second flanges 121, 31.

The tying tool 5 is an elongated member, one end thereof has a fastening unit 51, e.g. a C-shaped connecting ring, connected to the base sheet 1, the other end thereof has a ring unit 52 capable of being connected to a connected unit, e.g. a conventional buckling ring (not shown), so the pacifier is connected to the buckling ring. In this embodiment of the present invention, for achieving a better appearance and more fun to use, a plurality of geometric decoration balls 53 are installed between the fastening unit 51 and the ring unit 52 of the tying tool 5, so as to form a decoration bend. Stopping sheets 511 installed at the bottom ends of the fastening unit 51 of the C-shaped connecting ring are installed in fastening holes 16, 61 correspondingly installed at the peripheries of the base sheet 1 and a decoration sheet 6, so the fastening unit 51 of the tying tool 5 is fastened between the base sheet 1 and the decoration sheet 6.

Referring from FIG. 2 to FIG. 4, the surface of the base sheet 1 is able to be printed or laminated with plane patterns or directly glued with three dimensional objects. For achieving a better outlook and shielding hollow holes formed during the mold fabrication, the decoration sheet 6 having the same size and style as the base sheet 1 is connected to the rear end of the base sheet 1; after the decoration sheet 6 and the base sheet 1 are combined, an ultrasonic operation is processed for sealing the two. The surface of the decoration sheet 6 can also be printed or laminated with plane patterns or directly glued with three dimensional objects.

Through holes 17, 62 can be further installed on the base sheet 1 and the decoration sheet 6, in other words the base sheet 1 and the decoration sheet 6 are installed with a plurality of through holes 17, 62 that communicate with each other; so when an infant accidentally swallows the pacifier, he is prevented from suffocating and more rescue time is obtained. Safety regulations for said incident have been established by many countries.

When assembling the present invention, the pulling member 2 and the latching member 3 are respectively installed from the top end and the bottom end of the sheet slot 13, so the sheet tenon 22 of the pulling member 2 passes through the angled tenon 124 installed at the bottom end of the connecting sheet 12; the second flange 31 of the latching member 3 is provide adjacent to the rear end of the first flange 121 so the convex positioning bumps 312 are received in the concave positioning holes 126, and the pressing sheet 221 at the bottom end of the sheet tenon 22 is placed at the top oblique surface of the block 321. Then the bottom end of the clamping member 4 is inserted towards the first and the second flanges 121, 31, so the lock holes 41 and the shaft holes 42 are respectively buckled with the buckling hooks 122 and the tenon shafts 311 correspondingly installed on the first and the second flanges 121, 31, and the clamping buckles 441 provided at the inner ends of the two arc-shaped clamping sheets 44 are respectively buckled in the buckling slots 127, 314 preset on the surfaces of the first and the second flanges 121, 31, so the connecting sheet 12 and one end of the latching member 3 establishes an elastic clamping status, as shown in FIG. 4 and FIG. 5*a*.

Figure 6A:
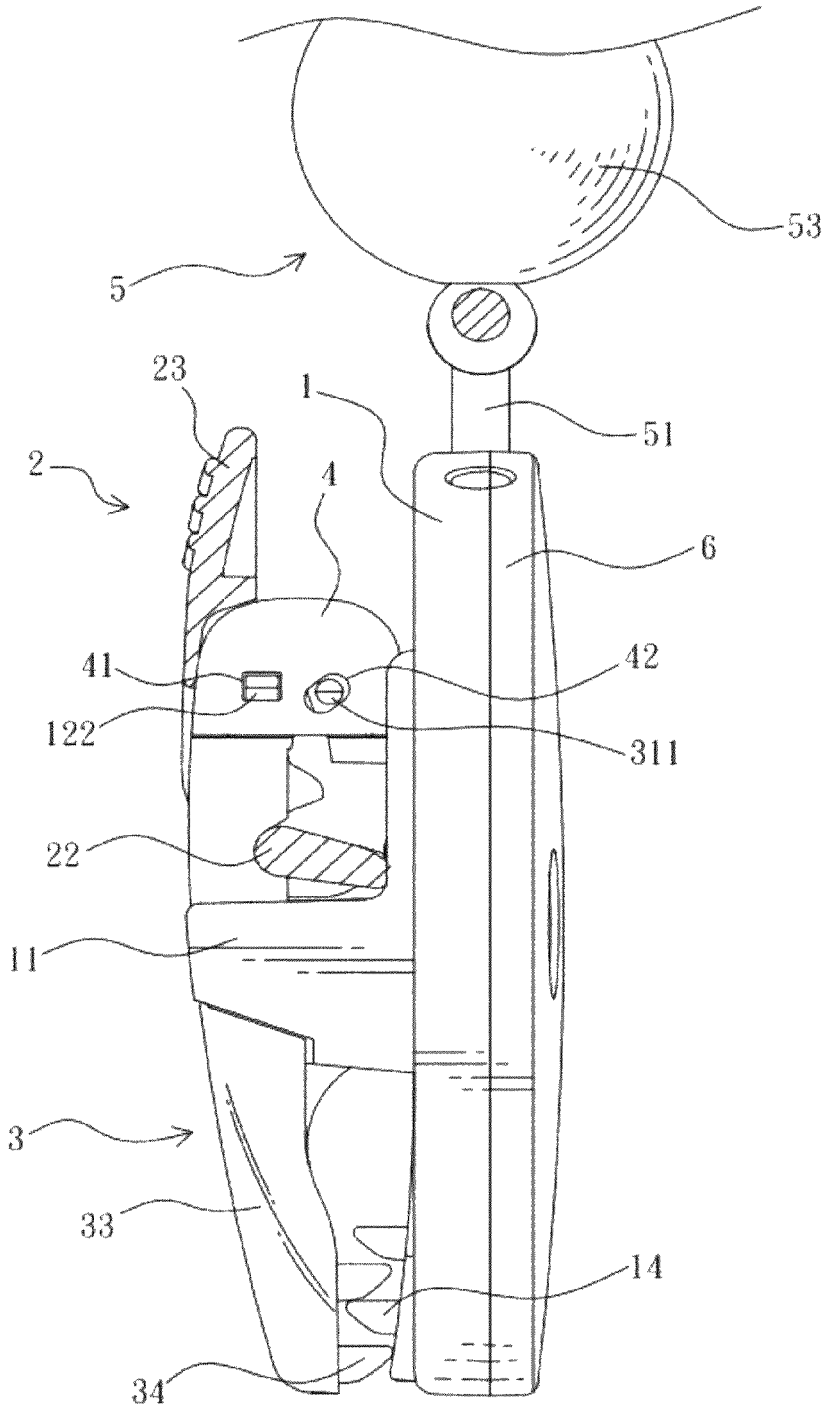
FIG. 6*a* is a schematic view of the clamping member in the clamping status and the first and the second flanges after being assembled.

Because the buckling hooks 122 are wedge-shaped reversed hooks, after being buckled with the lock holes 41 that are in rectangular shapes, a latching status is obtained. As shown in FIG. 6*a*, the clamping member 4 is fully connected with the first and the second flanges 121, 31; and when in a clamping status, the lock holes 41 and the shaft holes 42 are shielded by the wing sheets 21 so external tools can not be used for breaking, therefore the clamping member 4 is able to be stably fastened on the first and the second flanges 121, 31, so safety during operation is ensured.

Referring from FIG. 5*a* to FIG. 6*b*, when the safe pacifier clip provided by the present invention is desired to be released from clothes, the sheet button 23 is outwardly pulled so the pressing sheet 221 at the bottom end of the sheet tenon 22 is moved to the top oblique surface of the arc-shaped block 321, the block 321 is no longer pressed and the two arc-shaped clamping sheets 44 release energy, so the latching member 3 let the engaging sheet 32 and the clamping sheet 33 provided at the bottom end of the engaging sheet 32 forwardly raise and a gap is formed between the sheet teeth 14 and the engaging sheet 32 and the clamping sheet 33, as shown in FIG. 5*b;* so the present invention is able to be released from clothes. The gap between the clamping sheet 33 and the base sheet 1 can be served to enter edges of clothes or pockets, then the pulling member 2 is pressed, so the pressing sheet 221 of the sheet tenon 22 passes through and press on the bottom oblique surface of the block 321 to store energy, and the engaging sheet 32 and the clamping sheet 33 are backwardly moved; so the clamping teeth 34 and the sheet teeth 14 are engaged in an intercross means as shown in FIG. 5*a*, therefore the base sheet 1 is clamped on the clothes.

As shown in FIG. 6*a*, the shaft hole 42 is a round elongated hole, so the shaft hole 42 has a distinct appearance with regard to the rectangular lock hole 41, which can be used as an anti-error function; and the tenon shaft 311 of the second flange 31 is disposed in front of the shaft hole 42 when the shaft hole 42 is in a clamping-thin-clothes or in a releasing status.

Figure 6B:
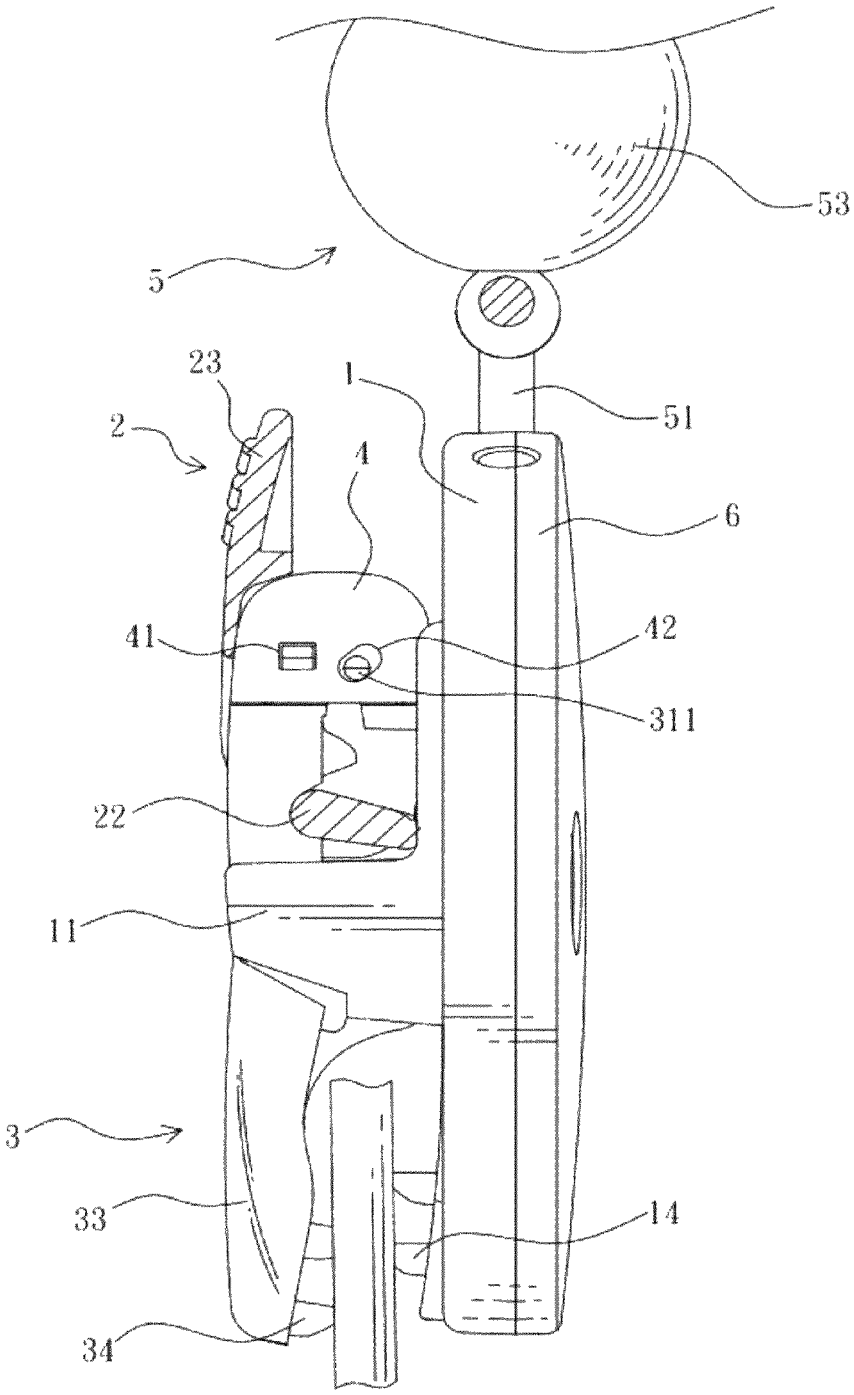
FIG. 6*b* is a schematic view of the clamping member clamping on thicker clothes and the first and the second flanges.

As shown in FIG. 6*b*, when the preset invention is desired to be clamped on thick clothes, e.g. winter clothes or jackets, the second flange 31 is slightly expanded due to the thickness of the clothes, so the tenon shaft 311 of the second flange 31 is moved to the rear end of the shaft hole 42.

The advantages provided by the present invention are as followings: the height of the connected sheet is lower than that of the pulling member and the pair of sheet columns, so in an impact test the impact force is sustained by the pulling member and the sheet columns for dispensing the impact force, the connecting sheet is therefore prevented from being broken, so operation safety is ensured; the size of the pulling member is enlarged so people with larger fingers can easily operate the pulling member; moreover, the connecting sheet and the first and the second flanges of the latching member of the pacifier clip of the present invention are buckled and clamped by the cap-shaped resilient clamping member, so a loose status is avoided and is protected from being harmed by external forces, and a firm structure and anti-loosing effect are achieved; the present invention also complies with safety regulations established by various nations or regions, especially the European Union.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safe pacifier clip, comprising:

a base sheet, a connecting sheet is longitudinally connected between two protruding sheet columns and the height of the connecting sheet is lower than that of the sheet columns, a sheet slot is defined between the connecting sheet and the base sheet, a first flange is installed on the top end of the connecting sheet, at least one row of sheet teeth is adjacently installed at the lower portion of the connecting sheet;

a rack-shaped pulling member, distance between two wing sheets respectively installed at two lateral ends of the pulling member is corresponding to the sheet columns, and the pulling member is installed to the connecting sheet through the top end of the sheet slot, a sheet tenon is transversally installed at the bottom ends of the pair of wing sheets, a pressing sheet is installed at the bottom end of the sheet tenon, and a sheet button having a height at least equal to the heights of the sheet columns is installed on the top ends of the two wing sheets;

a latching member having a multi-folded shape, a second flange installed on the top end thereof is installed to the connecting sheet through the bottom end of the sheet tenon and is provided adjacent to the inner surface of the first flange, the second flange is bent then is connected to an engaging sheet having an arc-shaped block, the engaging sheet is bended then is connected to a clamping sheet, at least one row of clamping teeth is installed at the rear end of the clamping sheet;

a cap-shaped clamping member, an opening at the bottom end thereof is provided to the first and the second flanges that are in a stacking status, and arc-shaped clamping sheets provided at the front and the rear ends of the clamping member clamp the two flanges, and an elongated tying tool, one end thereof is installed with a fastening unit fastened on the base sheet, the other end thereof is installed with a connecting unit;

when the pulling member is pulled, the pressing sheet of the sheet tenon is optionally moved and positioned at a top or a bottom oblique surfaces of the block, and the two arc-shaped clamping sheets connected to the two flanges release or store energy, so the clamping sheet at the other end of the latching member is outwardly raised or inwardly clamped, and a gap or an engaging status is formed between the clamping teeth and the sheet teeth.

2. The safe pacifier clip as claimed in claim 1, wherein two lateral ends of the first and the second flanges of the connecting sheet and the latching member are respectively installed with a pair of buckling hooks and a pair of tenon shafts, and two lateral ends of the clamping member is correspondingly installed with a pair of lock holes and a pair of shaft holes for being respectively buckled and positioned with the pair of buckling hooks and the pair of tenon shafts.

3. The safe pacifier clip as claimed in claim 2, wherein each lock hole is in a rectangular shape, each buckling hook is a wedge-shaped hook; each shaft hole is a round elongated hole, so the tenon shaft is able to be moved and positioned inside the shaft hole with respect to the thickness of clothes to be clamped.

4. The safe pacifier clip as claimed in claim 2, wherein the connecting surfaces of the first and the second flanges of the connecting sheet and the latching member are respectively and oppositely installed with convex positioning bumps and concave positioning holes having the same quantity as the convex positioning bumps and able to accommodate the convex positioning bumps.

5. The safe pacifier clip as claimed in claim 1, wherein each of the two arc-shaped clamping sheets is defined by two rib slots arranged in a left/right means, and the first and the second flanges are respectively and protrudingly installed with a pair of convex ribs with respect to the locations where the rib slots are installed, so the rib slots can accommodate the convex ribs.

6. The safe pacifier clip as claimed in claim 1, wherein each inner end of the two arc-shaped clamping sheets of the clamping member is installed with a clamping buckle respectively buckled with buckling slots preset on the surfaces of the first and the second flanges.

7. The safe pacifier clip as claimed in claim 1, wherein a pair of sheet steps is longitudinally extended from the bottom ends of the pair of sheet columns for being connected to the bottom ends of the two wing sheets of the pulling member.

8. The safe pacifier clip as claimed in claim 1, wherein a wedge-shaped angled tenon is protrudingly installed at the inner end of the connecting sheet to let the sheet tenon of the pulling member pass through and serve as a limitation, a transversal tenon slot is adjacently installed below the angled tenon for receiving the top end of the sheet tenon.

9. The safe pacifier clip as claimed in claim 1, wherein further comprising an elongated tying tool, one end thereof is installed with a fastening unit fastened on the base sheet, and the other end thereof is installed with a ring unit.

10. The safe pacifier clip as claimed in claim 9, wherein a plurality of geometric decoration balls are installed between the fastening unit and the ring unit of the tying tool.

11. The safe pacifier clip as claimed in claim 1, wherein the base sheet is further installed with a decoration sheet having the same size and style as the base sheet; after the two are connected, a high frequency wave operation or a gluing agent is used to combine the base sheet and the decoration sheet.

12. The safe pacifier clip as claimed in claim 11, wherein the front end of the decoration sheet is printed or laminated with plane patterns or is glued with three dimensional objects.

13. The safe pacifier clip as claimed in claim 11, wherein the base sheet and the decoration sheet are installed with a plurality of through holes that communicate with each other.

* * * * *